US007059471B2

(12) United States Patent
Fattori

(10) Patent No.: US 7,059,471 B2
(45) Date of Patent: Jun. 13, 2006

(54) TOOTHBRUSH PACKAGE

(75) Inventor: Joseph Fattori, Mendham, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 11/072,727

(22) Filed: Mar. 4, 2005

(65) Prior Publication Data

US 2005/0145519 A1 Jul. 7, 2005

Related U.S. Application Data

(63) Continuation of application No. PCT/US03/27817, filed on Sep. 4, 2003.

(60) Provisional application No. 60/408,354, filed on Sep. 5, 2002.

(51) Int. Cl.
*B65D 83/10* (2006.01)

(52) U.S. Cl. ..... 206/362.3; 206/362.2

(58) Field of Classification Search ..... 206/15.1, 206/15.2, 361, 362.1, 362.2, 362.3; 132/286, 132/308; 312/206, 207
See application file for complete search history.

(56) References Cited

U.S. PATENT DOCUMENTS

| | | | | | |
|---|---|---|---|---|---|
| 2,304,227 | A | * | 12/1942 | Zafarana | 206/362.2 |
| 2,424,098 | A | * | 7/1947 | Kaskouras | 206/362.3 |
| 2,508,773 | A | * | 5/1950 | Reichmuth | 312/206 |
| 2,719,626 | A | | 10/1955 | Lermner | |
| 2,725,270 | A | * | 11/1955 | Lewis | 312/207 |
| 2,937,910 | A | * | 5/1960 | Randa | 312/207 |
| 5,052,301 | A | | 10/1991 | Walker | |
| 5,052,556 | A | * | 10/1991 | Wilkinson | 206/362.2 |
| 5,505,301 | A | | 4/1996 | Foley | |
| 5,625,916 | A | | 5/1997 | McDougall | |
| RE35,941 | E | | 11/1998 | Stansbury | |
| 6,189,693 | B1 | | 2/2001 | Blaustein et al. | |
| 6,311,837 | B1 | | 11/2001 | Blaustein et al. | |
| 6,371,294 | B1 | | 4/2002 | Blaustein et al. | |

* cited by examiner

*Primary Examiner*—Luan K. Bui
(74) *Attorney, Agent, or Firm*—Harris A. Wolin

(57) ABSTRACT

A package for displaying certain features of a toothbrush is disclosed. The package includes a movable slider bar as part of the package that can be manipulated by a potential consumer. The slidable bar engages a movable portion of a toothbrush so that a potential customer can observe that movement without opening the package.

20 Claims, 4 Drawing Sheets

TOOTHBRUSH PACKAGE

This application is a continuation of application PCT/US2003/27817, filed Sep. 4, 2003, which claims the benefit of U.S. Provisional Application No. 60/408,354 filed Sep. 5, 2002, both of which are incorporated herein by reference in their entirety.

BACKGROUND OF THE INVENTION

As toothbrush design has evolved in an effort to improve cleaning of teeth and gums, the complexity of toothbrushes and their functions have increased. Powered toothbrushes are one example of efforts to improve tooth cleaning by including one or more movable sets of cleaning elements. Another approach to improving cleansing of teeth is use of a toothbrush head that is articulated or segmented to better follow the rounded curvature of teeth aligned in the human jaw.

Marketing such toothbrush improvements, however, has its problems. More specifically, toothbrushes typically are sold in sealed packaging to prevent dirt and germs from reading the toothbrush before use. One type of such packaging is blister packaging which is typified by a transparent, thermoformed shell largely molded to the shape of the object being sold which is made of polyvinyl chloride (PVC), polystyrene or cellulosic plastics. That transparent shell is typically sealed to an underlying hardboard card containing product information and promotional material.

Sealed packaging, such as blister packs, however, separate the consumer from the product. Where features of the product are not readily evident by merely looking at the packaging, it can be difficult to market those features to the consumer. Accordingly, some manufacturers have attempted to provide means in the packaging to operate features of their product that are best understood when in operation.

One example of this approach is packaging which enables actual operation of powered toothbrushes even though sealed in their packaging. Examples of this approach are U.S. Pat. Nos. 6,189,693 B1 and 6,371,294 B1 issued to Blaustein et al. They disclose a blister pack with a prominent display on the front thereof which contains an arrow pointing to a button and invites the potential customer to "Try Me" (See FIG. 8 of Blaustein et al. patents). If the customer follows this invitation the blister pack is depressed which in turn activates the on-off switch on a power toothbrush. Thus, a potential customer can actually observe the operation of the powered portions of the toothbrush through transparent portions of the packaging overlying these portions of the toothbrush.

Another patent disclosing means for activation of a power toothbrush at the point-of-purchase while maintaining the sealed condition of its packaging, is U.S. Pat. No. 6,311,837B1 also issued to Blaustein et al. This patent discloses a small recess 26 in the blister packaging aligned with the on-off switch of the powered toothbrush. In operation, the toothbrush can be temporarily energized at the point-of-sale by pressing the recess 26 down until it contacts the on-off switch. When pressure on the recess 26is released, the switch returns to its original position and the power is deactivated (See column 4, lines 19–41).

While pushing down on a portion of package may permit operation of a button operated powered device such as a toothbrush, that approach will not suffice where the features of the device are not operable by the simple push of a button.

This invention discloses means of allowing consumer implementation of product features that are not readily susceptible to push button operation.

SUMMARY OF THE INVENTION

The disclosed packaging of the invention permits ready demonstration of features of products sold in closed packages. In the disclosed packaging a potential consumer is provided with means to manipulate features of a toothbrush without having to open the toothbrush package. The packaging invites the consumer to flex the tip of the head of a toothbrush.

Toothbrushes with flexible tips are known. The flexible tips on toothbrushes accommodate to the curvature of the human jaw as well as the relatively straight portions of the jaw. The existence and operation of the flexible tip of such toothbrushes may not, however, be readily apparent to a potential customer. For example, the space on the package for printed instructions or marketing materials to explain the existence and advantages of a flexible tip is limited because of the small size of a typical toothbrush package.

Therefore, it would be advantageous to have a means on the package to demonstrate the existence and movement of the flexible tip. Thus, it is an object of this invention to provide a package which allows manipulation and movement of a portion of a toothbrush by a potential customer while maintaining the sealed condition of that package. This and other objects of this invention are achieved by including a slidable bar movable across a portion of the package.

This slidable bar has a first portion extending outside the package and accessible to the potential customer. A second portion extends into the package and engages a movable portion of the device in the package, e.g., the flexible head of a toothbrush. The first and second portions of the slidable bar are operably joined so that movement of one portion causes movement of the other.

This slider can be snap fit into a slot in the top of a package or it can be trapped between two halves of a molded package having mating recesses that form a slot for operation of the slidable bar. The slider is molded with ribs that engage the top and/or bottom of the opening of the package which allows the slider to move transversely without falling out of the package. The slider is preferably of a shape that the opening or slot in the package is always covered by a portion of the slidable bar, thereby maintaining the package in sealed condition.

BRIEF DESCRIPTION OF THE DRAWINGS

This invention is capable of use in a broad array of consumer packaging and products. The drawings illustrate one use of the invention and are not to be construed as the only embodiment of the invention.

DETAILED DESCRIPTION OF THE PREFERRED EMBODIMENT

Figure 1:
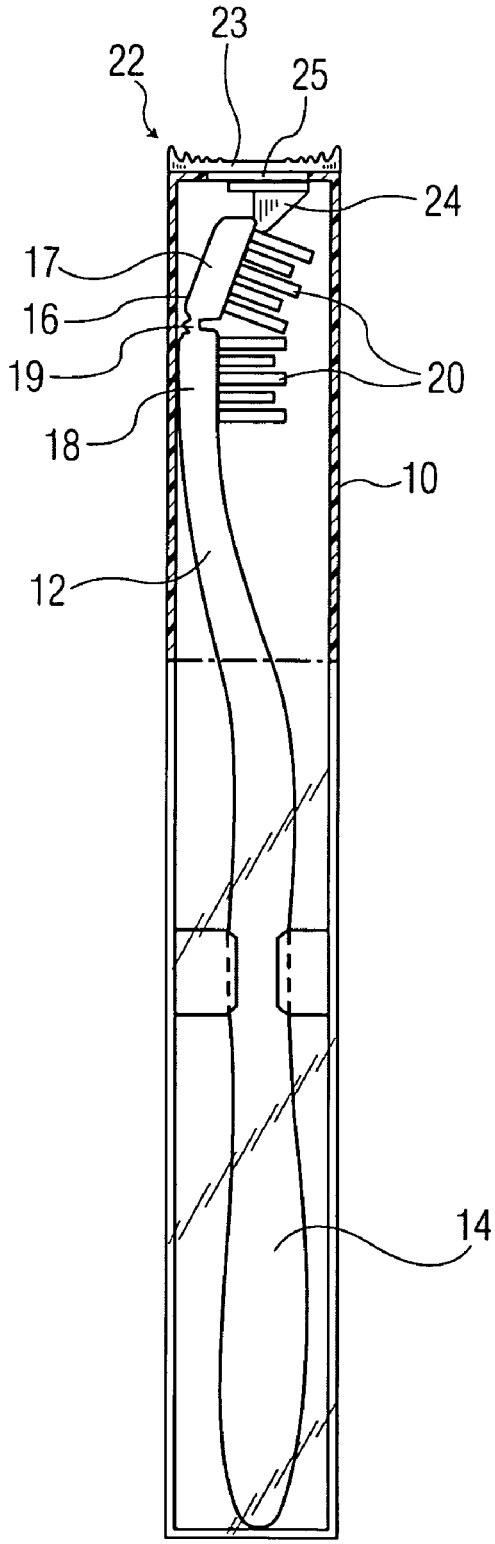
FIG. 1 is a side elevational view, partially broken away, showing a toothbrush package with a slider to allow consumer manipulation of a feature of the toothbrush, i.e., the flexible portion of the toothbrush head.
Figure 2:
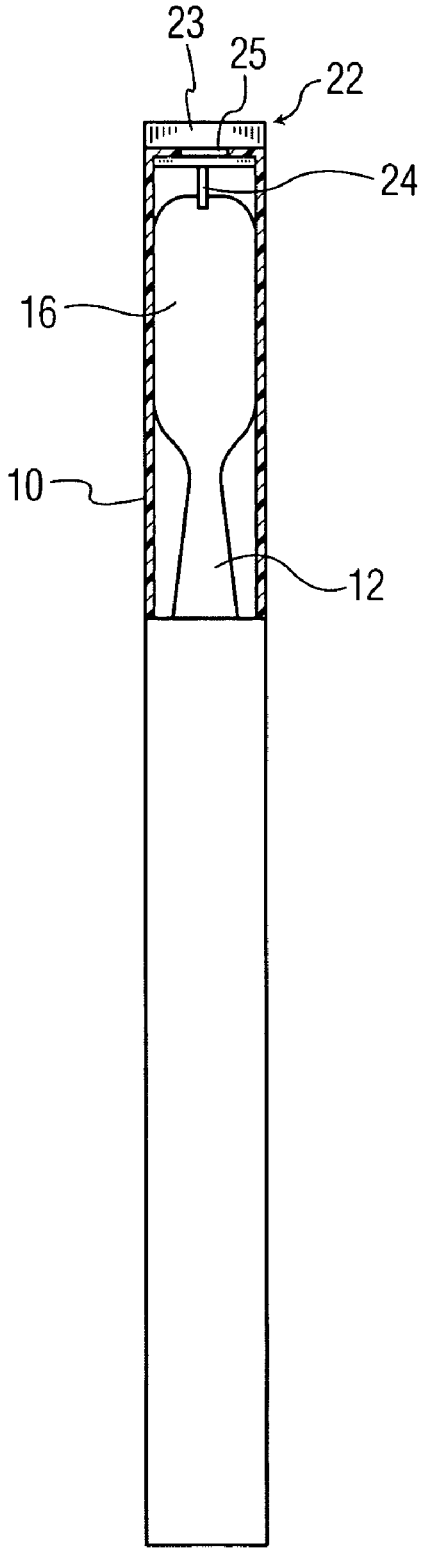
FIG. 2 is a front elevational view partially broken away of the package of FIG. 1.
Figure 3:
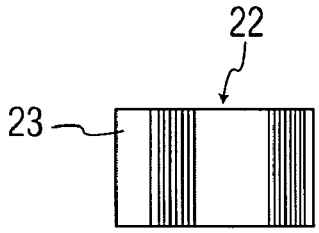
FIG. 3 is a top plan view of FIGS. 1 and 2.

The package 10 illustrated in FIGS. 1–5 contains a toothbrush 12 having a relatively rigid handle 14. The handle 14 can be covered in elastomeric material to improve feel and grip.

The illustrated toothbrush 12 includes an articulated head portion 16 containing a relatively rigid portion 18 connected to handle 14. That portion is connected to a movable portion 17 of the head. The movable and relatively rigid portions are connected by a flexible hinge 19 that is preferably molded into the head 16. The desired flexibility can be achieved by thinning out material in the head 16 near the location of flexible hinge 19 or by incorporating a more flexible material, such as an elastomeric, in the region of the hinge 19. Cleaning elements 20 are arranged in both portions of head 16 in a known manner. Any suitable form of cleaning elements may be used as the cleaning elements 20 in the broad practice of this invention. The term "cleaning elements" is intended to be used in a generic sense which could include conventional fiber bristles or massage elements or other forms of cleaning elements such as elastomeric fingers or walls arranged in a circular cross-sectional shape or any type of desired shape including straight portions or sinusoidal portions. Where bristles are used, the bristles could be mounted to tuft blocks or sections by extending through suitable openings in the tuft blocks so that the base of the bristles is mounted within or below the tuft block.

It is to be understood that the specific illustration of the cleaning elements is merely for exemplary purposes. The invention can be practiced with various combinations (such as stapled or in-mold technology bristles, etc.) and/or with the same bristle or cleaning element materials (such as nylon bristles, spiral bristles, rubber bristles, etc.) Similarly, while the Figures illustrate the cleaning elements to be generally perpendicular to head 16, some or all of the cleaning elements may be angled at various angles with respect to the surface of head 16. It is thereby possible to select the combination of cleaning element configurations, materials and orientations to achieve specific intended results to deliver additional oral health benefits, like enhanced cleaning, tooth polishing, tooth whitening and/or massaging of the gums.

Figure 4:
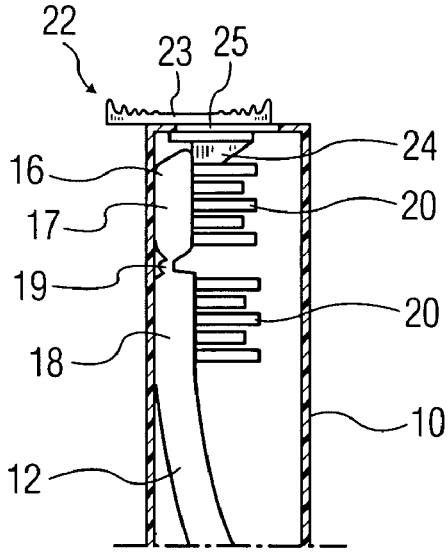
FIG. 4 is a fragmented side elevational view showing the slider moved to the left to manipulate a flexible toothbrush head.
Figure 5:
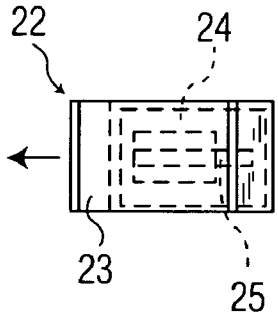
FIG. 5 is a top plan view of FIG. 4.
Figure 6:
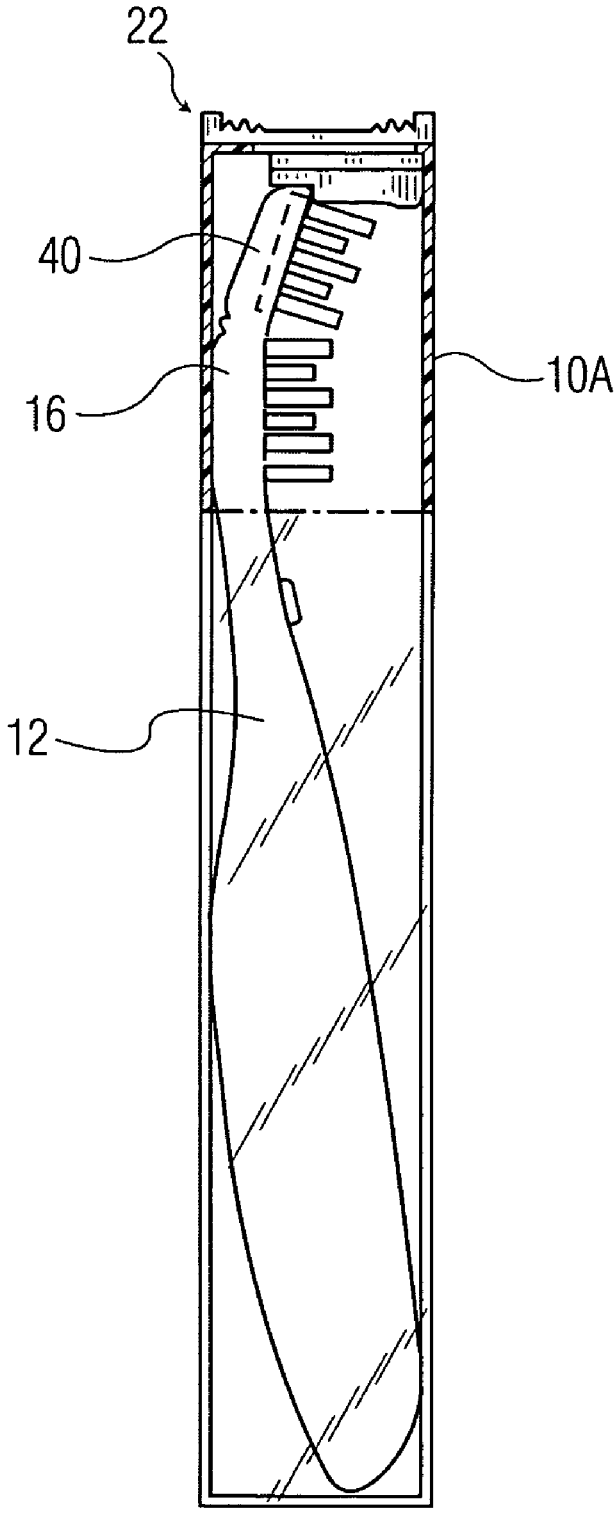
FIG. 6 is a side elevational view, partially broken away, showing a package for a powered toothbrush with a slider.

The movable portion 17 of head 16 is preferably molded so that it is angled relative to the fixed portion 18 of the head 18, but can rotate counterclockwise (as seen in FIGS. 1, 4 and 6) when the user applies force to the toothbrush handle 14. The forward tilt of movable portion 17 creates a curvature in head 16 that is particularly adopted to cleansing of teeth in the curved portion of the human jawline. As the toothbrush is moved in use toward the back teeth, which are in a straighter alignment, the movable portion 17 of head rotates about flexible hinge 19 so it is better aligned with those teeth.

The ability of the toothbrush head to adapt to these differing configurations of teeth in the human jaw is not readily apparent when it is displayed in a sealed package on the store shelf. To promote this feature, this invention provides a package 10 with a slider bar 22 which is movable relative to the package 10. The slider bar 22 has a portion 23 extending outside package 10 which is shaped to receive and retain the finger of a person holding the package. Suitable graphics and instructions on the package 10 would invite the holder to push or pull the slider bar 22 in order to move the movable portion 17 of head 16. Movement of this portion 17 of the toothbrush head is accomplished by the portion 24 of slider bar 22 extending inside the package 10. This portion 24 of slider 22 has a point or notch that engages the upper end of the flexible portion of head 17 so that the movement of slider 22 causes corresponding movement to the flexible portion of head 17. In this way, the potential purchaser of the toothbrush is able to view and understand an important feature of the toothbrush, the flexible head, that provides improved tooth cleaning.

Slider bar 22 is designed to move in slot 25 in package 10. This slot can be molded into the package or created by mating recesses in mating halves of package 10 when molded. Preferably, the slot 25 is dimensioned to allow the lower portion 24 of slider 22 to be pushed through during assembly of the package and insertion of the toothbrush. A slight undercut in portion 24 keeps the slider 22 attached to the package 10. The upper surface of the upper portion 23 of the slider is preferably bigger than the slot in all positions of the slider 22 so that the package 10 remains sealed until the toothbrush 12 is removed from package 10.

FIG. 6 illustrates packaging 10A for a powered version of toothbrush 12 wherein portions 40 of the head 16 are moved under power or may contain a powered set of cleaning elements. In operation, application of finger pressure on upper portion 22 causes movement of slider 22. That movement illustrates the flexible feature of head 16 to potential consumers.

The movable section 40 could be oscillated rotationally such as by using the type of drive mechanism shown in U.S. Pat. No. 5,625,916, or could move in and out using the type of drive mechanism shown in U.S. Pat. No. RE 35,941; all of the details of both patents are incorporated herein by reference thereto. Alternatively, the other types of drives referred to above could move section 40 in other manners and directions. Although FIG. 6 shows movable section 40 to be at one end of the head 16, the movable section(s) would be located at any desired location on the head.

What is claimed is:

1. A package for displaying a toothbrush with a flexible head prior to purchase comprising a sealed container for the toothbrush having at least one opening therein adjacent the flexible head, a slider bar arranged for sliding engagement of the flexible head in the opening, the slider bar having a surface outside the confines of the container suitable for sliding movement upon application of pressure and a portion of the slider bar inside the container that engages the flexible head of the toothbrush while maintaining the container in a sealed condition.

2. The package of claim 1 wherein at least some portion of the slider bar covers the opening in the container during use.

3. The package of claim 1 wherein the slider bar is positioned on an upper surface of the package.

4. The package of claim 1 wherein the portion of the slider bar inside the container extends downwardly relative to the opening.

5. The package of claim 1 wherein the slider bar further comprises side edges that are flush with side edges of the package prior to movement of the slider bar for engagement with the flexible head of a toothbrush.

6. The package of claim 5 wherein movement of the slider bar to engage the flexible head of a toothbrush causes the side edges to move out of a position that is flush with the package side edges.

7. The package of claim 1 wherein the slider bar further comprises gripping ridges.

8. The package of claim 1 wherein the slider bar has a concave contour.

9. A package for displaying a toothbrush with a movable portion prior to purchase comprising:

an unopened container having an access to the movable portion of the toothbrush, a bar arranged in said access for movable engagement with the toothbrush movable portion for movement of said toothbrush movable portion from a first position to a second position, the bar having a first portion accessible from outside the container for movement relative to the container upon application of pressure, and a second portion inside the container that movably engages the movable portion of the toothbrush for movement of said toothbrush movable portion from the first position to the second position while maintaining the container in an unopened condition.

10. The package of claim 9 wherein the access is an opening in said container and at least some portion of the bar covers the opening in the container during use.

11. The package of claim 9 wherein the bar is positioned on an upper surface of the package.

12. The package of claim 9 wherein the second portion of the bar extends downward relative to the opening.

13. The package of claim 9 wherein the bar further comprises side edges that are flush with side edges of the package prior to movement of the bar, and wherein movement of the bar to engage the movable portion of a toothbrush causes the side edges of the bar to move out of a position that is flush with the package side edges.

14. The package of claim 9 wherein the bar has a concave contour.

15. A package far displaying a toothbrush with a movable portion prior to purchase comprising:

an unopened container having a toothbrush with a movable portion, and a slider positioned adjacent the movable portion and arranged for movable engagement with the movable portion for movement of the movable portion from a first position to a second position while maintaining the package in an unopened condition, the slider having a first portion accessible from outside the container for movement relative to the container upon application of pressure, and a second portion inside the container that movably engages the movable portion of the toothbrush for movement from the first position to the second position.

16. The package of claim 15, wherein the slider is positioned in an opening along an upper surface of the container.

17. The package of claim 16 wherein at least some portion of the slider covers the opening in the container during use.

18. The package of claim 15 wherein the second portion of the slider extends downward relative to the opening.

19. The package of claim 15 wherein the slider further comprises side edges that are flush with side edges of the package prior to movement of the slider for engagement with the movable portion of the toothbrush, and wherein movement of the slider to engage the movable portion causes the side edges of the slider to move out of a position that is flush with the package side edges.

20. The package of claim 15 wherein the slider has a concave contour.

* * * * *